United States Patent [19]

Bennett

[11] Patent Number: 4,869,452

[45] Date of Patent: Sep. 26, 1989

[54] MOUNTING ARRANGEMENTS FOR WRITING PADS

[75] Inventor: Paul L. Bennett, Lane Cove, Australia

[73] Assignee: Paul Bennett Creative Consultancy Pty. Ltd., North Sydney, Australia

[21] Appl. No.: 216,038

[22] Filed: Jul. 7, 1988

[30] Foreign Application Priority Data

Jul. 10, 1988 [AU] Australia ..... PI3035

[51] Int. Cl.[4] ..... A47B 19/00

[52] U.S. Cl. ..... 248/441.1; 248/447; 281/42

[58] Field of Search ..... 248/441.1, 442.2, 447, 248/448, 118.1; 281/42

[56] References Cited

U.S. PATENT DOCUMENTS 1,249,015 12/1917 Brink ..... 248/441.1 X 1,625,895 4/1927 Katz ..... 248/441.1

3,948,476 4/1976 Kuniyosi ..... 248/447 X 4,666,409 5/1987 Sandberg ..... 248/441.1 X

*Primary Examiner*—Ramon O. Ramirez

*Attorney, Agent, or Firm*—Michael F. Petock

[57] ABSTRACT

A device for mounting a writing pad structure having dual faces on opposite sides, comprises a frame structure having parallel members which may be inserted in a folder or compendium. A transverse member is connected between the parallel members and slides along the length thereof. The writing pad structure is hingeably mounted on the transverse member such that the writing pad structure can be turned over to expose either face thereof, the transverse member sliding along the parallel frame member, to permit writing to take place on the exposed face. The writing pad structure remains substantially within the zone defined by the parallel frame members.

12 Claims, 4 Drawing Sheets

MOUNTING ARRANGEMENTS FOR WRITING PADS

BACKGROUND OF THE INVENTION

This invention relates to devices for mounting writing pads and the like for insertion in compendiums, diaries, wallets, clip boards and the like.

Very often it is desirable when using a compendium or diary to have available more than one writing surface to record details of separate activities, projects and the like. The compendium itself provides a useful surface on which to write, and whilst two pad areas can be provided on either open side of say a compendium, this is generally inconvenient as other reference material is generally also required beside the writing pad surface. A single pad could be simply hinged to provide access to the front and back, but when rotated to expose the rear surface the pad would be both upside down and outside the area defined by the open compendium.

SUMMARY OF THE INVENTION

According to the present invention there is provided a device for mounting a writing pad structure having respective faces on opposite sides thereof, the device comprising a support structure having first and second elements spaced parallel to define therebetween a zone for receiving the writing pad structure, a transverse member connected between said spaced elements and for sliding motion along the length thereof, and mounting means for the writing pad structure hingeably mounted on the transverse member such that the writing pad structure can be turned over to expose either face thereof when the mounting means is displaced hingeably about the transverse member and the transverse member slides along the first and second elements, whereby the writing pad structure can be moved between respective positions substantially within the said zone for permitting writing to take place on the exposed face.

Preferably, the first and second parallel spaced elements are in the form of a pair of parallel wire frames which are fitted to a compendium or the like in one of several ways. For example, a pair of struts may connect respective ends of the frame elements, the struts being affixed (for example sewn) in to the compendium. Alternatively, the frame elements could be connected by means of one strut at corresponding ends of the frame elements, with a U-shaped wire frame depends from the other corresponding ends of the frame elements (with or without the addition of a strut connecting these other ends), the U-shaped wire frame being capable of insertion into a pocket of a compendium thereby providing a removable frame structure. The whole frame structure in any of the above embodiments may be integrally formed or where convenient formed from lengths of wire suitably welded together.

Preferably, the transverse member for sliding motion connected between the spaced elements is in the form of a wire strut having rings attached at either end, the rings being mounted on each of the respective frame elements to allow sliding motion therealong. The rings may be welded to the wire strut for example, or the strut and rings may be integrally formed from a single wire piece.

The writing pad structure is preferably a dual pad structure, in a head to toe arrangement. Whilst the hinge structure may be formed integrally with the dual pads it is preferred that the hinge structure is formed from a separate structure comprising a card which is folded around the slidable strut and to which the two pads may be removably mounted.

The invention extends to the incorporation of any of the above embodiments in a compendium or the like, or for use with any flat surface (e.g. clip-board with compendium attached-for doctors, researchers etc.), where it is desired to provide a dual surface writing pad structure.

DESCRIPTION OF THE DRAWINGS

For illustrative purposes only embodiments of the invention will now be described with reference to the accompanying Figures of which.

DESCRIPTION OF THE PREFERRED EMBODIMENT

Figure 1:
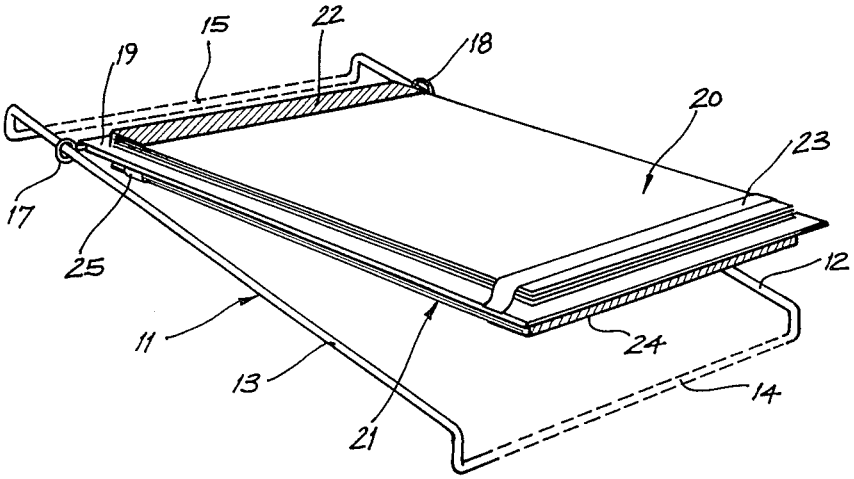
FIG. 1 is a perspective view of an embodiment according to the present invention.
Figure 2:
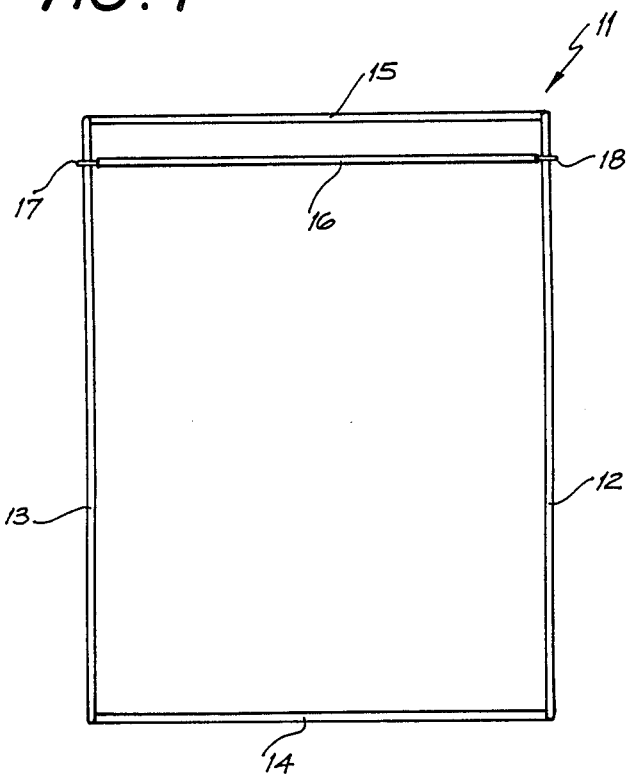
FIG. 2 is a plan view of the device of FIG. 1.
Figure 3:
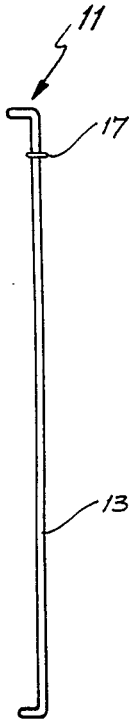
FIG. 3 is a side view of the same embodiment.

The device shown in FIGS. 1 to 3 comprises a coated wire frame 11 having a pair of parallel members 12 and 13 separated by cross members 14 and 15. The wire frame 11 may be suitably coated or chromed. Elements 14 and 15 may be conveniently sewn into a folder or compendium to secure the device. A coated wire strut 16 is provided with rings 17 and 18 at its extremeties which allow the wire strut 16 to travel the full length of the frame members 12 and 13. A support 19 for a pair of pads 20 and 21 consists of card folded around the coated wire strut 16, the card being suitably covered in PVC. The top 22 of pad 20 may be attached to the support 19 by any suitable means, such as gluing or by sliding the back of the pad into a slit in the PVC cover, whilst a clear plastic sleeve 23 is provided to hold the bottom of pad 20 securely. Similarly, top 24 of pad 21 is secured to the under side of support 19, for example, by means of a clipboard attachment 30 (illustrated in FIG. 4) and a clear plastic sleeve 25 is provided to hold the bottom of pad 21 securely.

Figure 4:
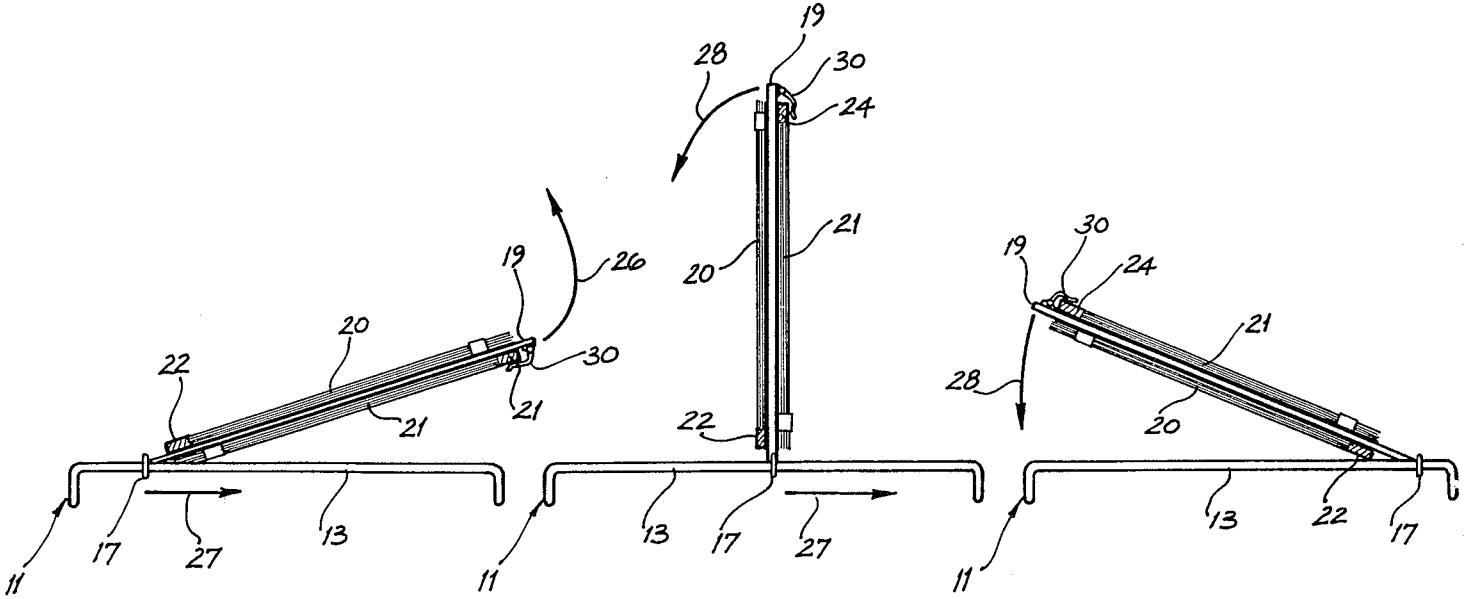
FIG. 4 is a diagrammatic representation of the way in which the writing pad structure can be turned over according to the present invention.

The operation of the above embodiment may be clearly understood with reference to FIG. 4, in which the elements as described above have the same reference numerals. By gripping the bottom end of the support 19 and lifting in the direction of arrow 26, the pad structure is allowed to slide along the wire frame members 12 and 13 in the direction of travel of arrow 27, specifically by means of rings 17 and 18. The follow through of lifting action 26 results in the pad support 19 being turned over and the bottom end thereof may be lowered in the direction of arrow 28. This results in bringing writing pad 21 into the writing position instead of pad 20. This operation of course can be reversed to bring pad 20 back into the writing position.

Figure 5:
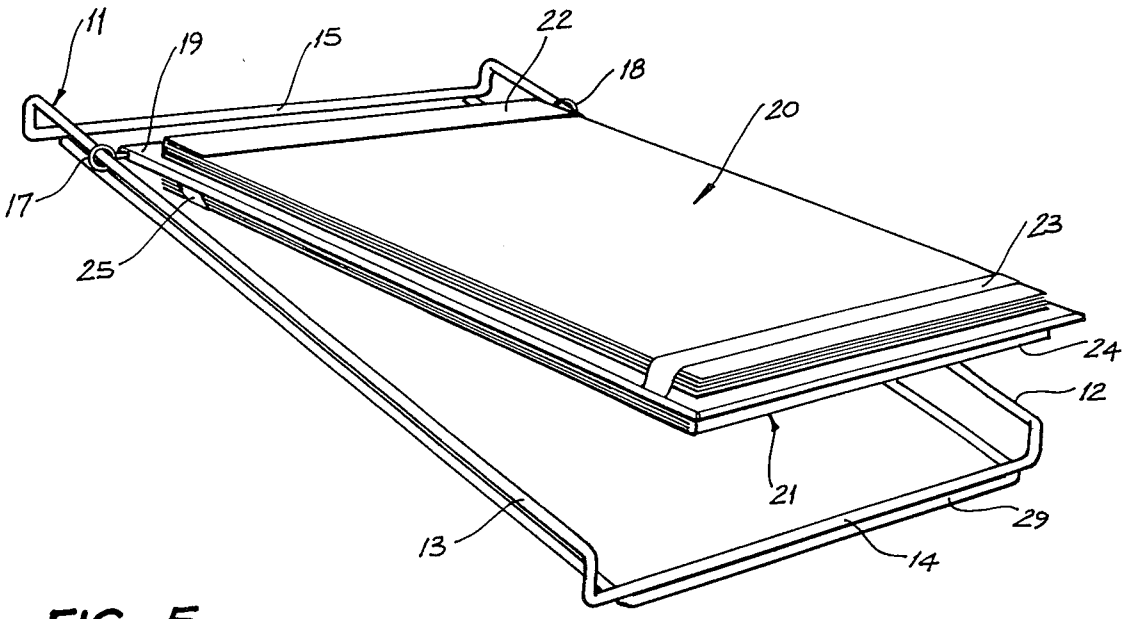
FIG. 5 is a perspective view of a further embodiment according to the present invention.
Figure 7:
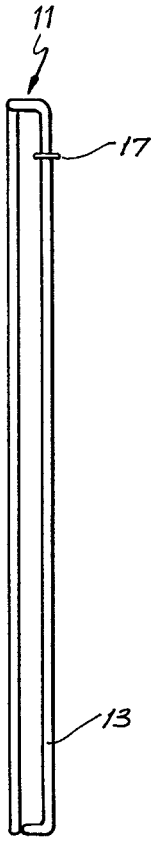
FIG. 7 is a side view of the same embodiment.
Figure 6:
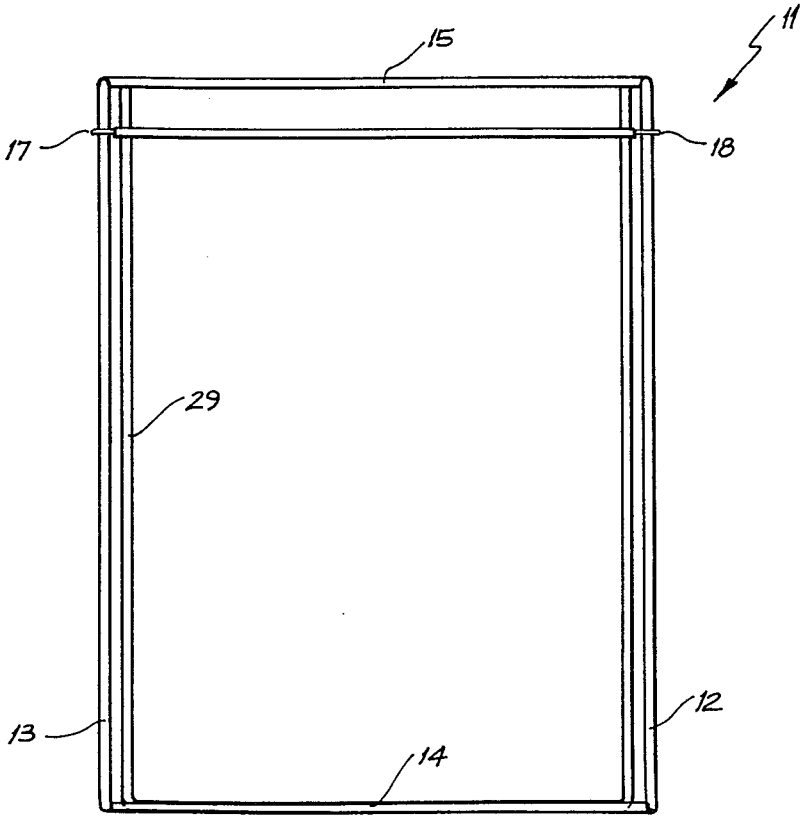
FIG. 6 is a plan view of the device of FIG. 5.

With reference to FIGS. 5 to 7, there is provided a second embodiment for which the reference numerals are the same as those for corresponding items in FIGS. 1 to 3. The operation of this further embodiment corresponds with that of FIGS. 1 to 3, as illustrated in detail in FIG. 4. The difference in this embodiment resides in the provision of a U-shaped frame 29 depending from cross member 15. U-shaped frame member 29 may be inserted into the pocket of a compendium allowing for removal and replacement of the whole frame structure.

What I claim is:

1. A device for mounting a writing pad structure having respective faces on opposite sides thereof, the device comprising a support structure having first and second elements spaced parallel to define therebetween a zone for receiving the writing pad structure, a transverse member connected between said spaced elements and for sliding motion along the length thereof, and mounting means for the writing pad structure hingeably mounted on the transverse member such that the writing pad structure can be turned over to expose either face thereof when the mounting means is displaced hingeably about the transverse member and the transverse member slides along the first and second elements, whereby the writing pad structure can be moved between respective positions substantially within the said zone for permitting writing to take place on the exposed face.

2. A device for mounting a writing pad structure according to claim 1, in which the first and second parallel spaced elements are in the form of a pair of parallel wire frames which may be fitted to a compendium, or any flat surface.

3. A device for mounting a writing pad structure according to claim 2, in which a pair of struts connect respective ends of the frame elements, the struts being affixed in to the compendium, or flat surface.

4. A device for mounting a writing pad structure according to claim 2, in which the frame elements are connected by means of one strut at corresponding ends of the frame elements, and a U-shaped wire frame depends from the other corresponding ends of the frame elements (with or without the addition of a strut connecting these other ends), the U-shaped wire frame being capable of insertion into a pocket of a compendium thereby providing a frame structure removable from the compendium, or flat surface.

5. A device for mounting a writing pad structure according to claim 2, in which the whole frame structure is integrally formed.

6. A device for mounting a writing pad structure according to claim 2, in which the whole frame structure is formed from lengths of wire suitably welded together.

7. A device for mounting a writing pad structure according to claim 2, in which the transverse member for sliding motion connected between the spaced elements is in the form of a wire strut having rings attached at either end, the rings being mounted on each of the respective spaced elements to allow sliding motion therealong.

8. A device for mounting a writing pad structure according to claim 7, in which the rings are welded to the wire strut.

9. A device for mounting a writing pad structure according to claim 7, in which the strut and rings are integrally formed from a single wire piece.

10. A device for mounting a writing pad structure according to claim 2, in which the writing pad structure is a dual pad structure, having writing pad surfaces on both sides thereof in a head to toe arrangement.

11. A device for mounting a writing pad structure according to claim 2, in which a hinge structure for hingeably mounting the pad structure on the transverse member is formed integrally with the pad structure.

12. A device for mounting a writing pad structure according to claim 2, in which a hinge structure for hingeably mounting the pad structure on the transverse member is formed from a separate structure comprising a card which is folded around the transverse member and to which two pads may be removably mounted.

* * * * *